US007237730B2

(12) United States Patent
Prociw et al.

(10) Patent No.: US 7,237,730 B2
(45) Date of Patent: Jul. 3, 2007

(54) MODULAR FUEL NOZZLE AND METHOD OF MAKING

(75) Inventors: Lev Alexander Prociw, Elmira (CA); Joseph Horace Brand, Mississauga (CA)

(73) Assignee: Pratt & Whitney Canada Corp., Longueuil, Québec (CA)

( * ) Notice: Subject to any disclaimer, the term of this patent is extended or adjusted under 35 U.S.C. 154(b) by 0 days.

(21) Appl. No.: 11/081,531

(22) Filed: Mar. 17, 2005

(65) Prior Publication Data

US 2006/0208105 A1 Sep. 21, 2006

(51) Int. Cl.
*B05B 7/10* (2006.01)
*B05B 7/06* (2006.01)

(52) U.S. Cl. ..... 239/406; 239/403; 239/405; 239/423; 239/424

(58) Field of Classification Search ..... 239/406, 239/403, 405, 423, 424, 418, 421, 424.5, 239/533.2; 60/740, 748, 735, 737
See application file for complete search history.

(56) References Cited

U.S. PATENT DOCUMENTS

| | | | | |
|---|---|---|---|---|
| 1,751,448 | A | | 3/1930 | Campbell, Jr. |
| 2,468,824 | A | | 5/1949 | Hughey |
| 2,694,245 | A | | 11/1954 | Rogers et al. |
| 2,775,566 | A | | 12/1956 | Crowley |
| 2,939,199 | A | | 6/1960 | Strivens |
| 3,266,893 | A | | 8/1966 | Duddy |
| 3,351,688 | A | | 11/1967 | Kingery et al. |
| 3,410,684 | A | | 11/1968 | Printz |
| 3,413,704 | A | | 12/1968 | Addoms, Jr. et al. |
| 3,416,905 | A | | 12/1968 | Waugh |
| 3,523,148 | A | | 8/1970 | Boyer et al. |
| 3,595,025 | A | | 7/1971 | Stöckel et al. |
| 3,615,054 | A | | 10/1971 | La Botz |
| 3,698,849 | A | | 10/1972 | Czerski |
| 3,704,499 | A | | 12/1972 | Majkrzak et al. |
| 3,775,352 | A | | 11/1973 | Leonard, Jr. |
| 3,782,989 | A | | 1/1974 | Mansur |
| 3,790,086 | A | * | 2/1974 | Masai ..... 239/406 |
| 3,831,854 | A | * | 8/1974 | Sato et al. ..... 239/406 |
| 3,888,663 | A | | 6/1975 | Reichman |
| 3,889,349 | A | | 6/1975 | Kaufman |
| 3,925,983 | A | | 12/1975 | La Botz |
| 3,982,778 | A | | 9/1976 | Spencer et al. |
| 4,011,291 | A | | 3/1977 | Curry |

(Continued)

FOREIGN PATENT DOCUMENTS

| | | |
|---|---|---|
| CA | 983215 | 2/1976 |

(Continued)

OTHER PUBLICATIONS

Polymer Technologies, Inc.; "Plastic and Metal Injection Molding"; www.polymertechnologies.com.

(Continued)

*Primary Examiner*—Kevin Shaver
*Assistant Examiner*—Darren Gorman
(74) *Attorney, Agent, or Firm*—Ogilvy Renault

(57) ABSTRACT

A modular fuel nozzle configuration is defined which permits lower-cost manufacturing operations such as injection moulding to be employed. Also described is a method of making such a component.

13 Claims, 8 Drawing Sheets

U.S. PATENT DOCUMENTS 4,029,476 A 6/1977 Knopp
4,076,561 A 2/1978 Lee et al.
4,094,061 A 6/1978 Gupta et al.
4,197,118 A 4/1980 Wiech, Jr.
4,225,345 A 9/1980 Adee et al.
4,236,923 A 12/1980 Takahashi et al.
4,274,875 A 6/1981 Cadle et al.
4,280,973 A 7/1981 Moskowitz et al.
4,283,360 A 8/1981 Henmi et al.
4,347,982 A * 9/1982 Wright ..... 239/405
4,386,960 A 6/1983 Iacovangelo et al.
4,415,528 A 11/1983 Wiech, Jr.
4,419,413 A 12/1983 Ebihara
4,472,350 A 9/1984 Urano
4,535,518 A 8/1985 Jaqua
4,615,735 A 10/1986 Ping
4,661,315 A 4/1987 Wiech, Jr.
4,708,838 A 11/1987 Bandyopadhyay et al.
4,734,237 A 3/1988 Fanelli et al.
4,765,950 A 8/1988 Johnson
4,780,437 A 10/1988 Smith
4,783,297 A 11/1988 Ito et al.
4,792,297 A 12/1988 Wilson
4,816,072 A 3/1989 Harley et al.
4,839,138 A 6/1989 Fitz
4,874,030 A 10/1989 Kuphal et al.
4,881,431 A 11/1989 Bieneck
4,898,902 A 2/1990 Nagai et al.
4,913,739 A 4/1990 Thümmler et al.
5,021,208 A 6/1991 Ludwig et al.
5,059,387 A 10/1991 Brasel
5,059,388 A 10/1991 Kihara et al.
5,064,463 A 11/1991 Ciomek
5,094,810 A 3/1992 Shira
5,098,469 A 3/1992 Rezhets
5,135,712 A 8/1992 Kijima et al.
5,155,158 A 10/1992 Kim
5,215,946 A 6/1993 Minh
5,244,623 A 9/1993 King
5,250,244 A 10/1993 Kimura et al.
5,279,787 A 1/1994 Ollrogge
5,284,615 A 2/1994 Ueda et al.
5,286,767 A 2/1994 Rohrbach et al.
5,286,802 A 2/1994 Uesugl et al.
5,310,520 A 5/1994 Jha et al.
5,312,582 A 5/1994 Donado
5,328,657 A 7/1994 Kamel et al.
5,332,537 A 7/1994 Hens et al.
5,338,617 A 8/1994 Workinger et al.
5,350,558 A 9/1994 Kawato et al.
5,366,679 A 11/1994 Streicher
5,368,795 A 11/1994 Quadir
5,380,179 A 1/1995 Nishimura et al.
5,397,531 A 3/1995 Pelris et al.
5,403,542 A 4/1995 Weinl et al.
5,409,650 A 4/1995 Holme
5,415,830 A 5/1995 Zhang et al.
5,421,853 A 6/1995 Chen et al.
5,423,899 A 6/1995 Krall et al.
5,429,792 A 7/1995 Luk
5,437,825 A 8/1995 Jensen
5,450,724 A 9/1995 Kesseli et al.
5,472,143 A 12/1995 Bartels et al.
5,476,632 A 12/1995 Shivanath et al.
5,482,671 A 1/1996 Weber
5,525,293 A 6/1996 Kagawa et al.
5,547,094 A 8/1996 Bartels et al.
5,554,338 A 9/1996 Sugihara et al.
5,574,957 A 11/1996 Barnard et al.
5,609,655 A 3/1997 Kesseli et al.
5,641,920 A 6/1997 Hens et al.
5,665,014 A 9/1997 Sanford et al.
5,669,825 A 9/1997 Shira
5,722,032 A 2/1998 Gay
5,730,929 A 3/1998 Majumdar et al.
5,848,350 A 12/1998 Bulger
5,864,955 A 2/1999 Hirai
5,950,063 A 9/1999 Hens et al.
5,977,230 A 11/1999 Yang et al.
5,989,493 A 11/1999 La Salle et al.
5,993,726 A 11/1999 Huang et al.
5,993,733 A 11/1999 Kawai
6,008,281 A 12/1999 Yang et al.
6,051,184 A 4/2000 Kankawa
6,060,017 A 5/2000 Yang et al.
6,071,325 A 6/2000 Schmitt
6,075,083 A 6/2000 Peiris
6,119,459 A 9/2000 Gomez et al.
6,159,265 A 12/2000 Kinoshita et al.
6,171,360 B1 1/2001 Suzuki et al.
6,224,816 B1 5/2001 Hull et al.
6,224,823 B1 5/2001 Lindenau et al.
6,289,677 B1 9/2001 Prociw et al.
6,319,437 B1 11/2001 Elsner et al.
6,321,449 B2 11/2001 Zhao et al.
6,322,746 B1 11/2001 LaSalle et al.
6,350,407 B1 2/2002 Sakata et al.
6,399,018 B1 6/2002 German et al.
6,406,663 B1 6/2002 Göransson
6,428,595 B1 8/2002 Hayashi et al.
6,468,468 B1 10/2002 Neubing et al.
6,560,964 B2 5/2003 Steinhorsson et al.
6,592,787 B2 7/2003 Pickrell et al.
6,669,898 B2 12/2003 Gressel et al.
6,730,263 B2 5/2004 Emst et al.
6,759,004 B1 7/2004 Dwivedi
6,764,643 B2 7/2004 Sagawa et al.
6,838,046 B2 1/2005 Luc et al.
6,843,955 B2 1/2005 Ghosh et al.
6,849,230 B1 2/2005 Feichtinger
6,863,228 B2 * 3/2005 Mao et al. ..... 239/399
6,871,773 B2 3/2005 Fukunaga et al.
6,939,509 B2 9/2005 Kochanek
7,018,583 B2 3/2006 Berger et al.
2002/0058136 A1 5/2002 Belhadjhamida
2002/0109260 A1 8/2002 Boechal
2003/0062660 A1 4/2003 Beard et al.
2005/0254987 A1 11/2005 Azzi et al.
2006/0127268 A1 6/2006 Yano et al.

FOREIGN PATENT DOCUMENTS

CA 990978 6/1976
CA 996784 9/1976
CA 2230994 3/1997
CA 2204841 11/1997
CA 2342328 3/2000
CA 2347639 4/2000
CA 2327759 5/2001
CA 2388359 5/2001
CA 2418265 2/2002
CA 2381828 10/2002
EP 0 511 428 B1 9/1996
EP 1 046 449 B8 10/2000
JP 03 039405 A 2/1991
JP 08 025151 A 1/1996
JP 08260005 A 10/1996
WO WO 97 38811 A 10/1997
WO WO 00/12248 3/2000

OTHER PUBLICATIONS

Phillips Plastics Corporation; "MIM Metal Injection Molding Design Guide"; Nov. 12, 2004; www.phillipsmetals.com.
Egide; "Advanced Material Injection Moulding (AMIM)".

"The MIM Process"; www.epma.com.
"Powder Injection Molding"; www.powdermetinc.com/Technology.htm.
COBEF (Congresso Braileiro de Engenharia de Fabricacao); Paulo César G. Felix; Philip Frank Blazdel; Ricardo Emilio F.Q Nogueira; "*Production of Complex Parts by Low-Pressure Injection Molding of Granite Powders*".
J. E. Zorzi; C. A. Perottoni; J. A. H. da Jornada; "Wax-Based Binder for Low-Pressure Injection Molding and the Robust Proudction of Ceramic Parts".
Azom.com; "Powder Injection Moulding of Metals, Ceramics and Metal Matrix Composites"; www.azom.com.
Ceramic Industry; Ceratechno 2006; Nov. 7 - 11, 2006; "Advancing Components with Low-Pressure Injection Molding"; www.ceramicindustry.com.
"Injection Molding Microstructures"; www.ecs.umass.edu.
TEMS - a division of ND Industries, Inc.; "Low Pressure Injection Overmolding Ruggedizing Electrical/Electronic Components"; www.temsnd.com.
Peltsman; "Low Pressure Injection Molding"; www.pelcor.com.
Peltsman; "Automatic LPM Machine MIGL -37"; www.pelcor.com.
Axom.com; "Low Pressure Powder Injection Moulding of Metals, Ceramics and Metal Matrix Composites"; www.azom.com.
Goceram; "Medium Pressure Powder Injection Molding (MEDPIMOLD) Process"; www.goceram.com.
Goceram; "Medium Pressure Injection Moulding Machines"; www.goceram.com.
U.S. Appl. No. 60/139,354, filed Jun. 15, 1999, Lasalle et al.

* cited by examiner

MODULAR FUEL NOZZLE AND METHOD OF MAKING

TECHNICAL FIELD

The technical field of the invention relates to fuel nozzles such as those for use in gas turbine engines, and in particular fuel nozzles which employ pressurized air.

BACKGROUND OF THE ART

Fuel nozzles vary greatly in design. One approach, shown in U.S. Pat. No. 5,115,634, involves the use of swirler airfoils or vanes arrayed around a central fuel orifice. Nozzles of this type can be costly to manufacture. Another approach, shown in the Applicant's U.S. Pat. No. 6,082,113 provides a plurality or air channels drilled around a central fuel orifice in a solid nozzle tip, which provides good mixing and is relatively cheaper to manufacture. However, the machining, drilling and finishing operations still require some time and precision to complete, and hence opportunities for cost-reduction yet exist.

SUMMARY OF THE INVENTION

In one aspect, the present invention provides a fuel nozzle for a gas turbine engine, in nozzle comprising a body defining at least a central fuel passage therethrough, the fuel passage exiting the body through a spray orifice, the body having a conical peripheral surface with the spray orifice disposed at an apex of the conical peripheral surface, the conical peripheral surface including a plurality of open-section channels defined therein, the channels radiating along the conical peripheral surface around the spray orifice; and an annular collar mounted to the body, the collar and conical surface of the body co-operating to define a plurality of enclosed air passages corresponding to the channels.

In a second aspect, the present invention provides a fuel nozzle for a gas turbine engine, the nozzle comprising: a body defining at least one fuel passage centrally therethrough, the fuel passage exiting the body through a spray orifice, the body having a conical peripheral surface with the spray orifice disposed at an apex of the conical peripheral surface, an annular collar mounted to the body around the conical surface, the collar and conical surface of the body co-operating to define a plurality of air passages therebetween, the air passages arranged in an array radiating around the spray orifice; wherein at least one of the body and the annular collar have a plurality of open-section channels defined therein, the channels partially defining the air passages.

In a third aspect, the present invention provides a method of making a fuel nozzle comprising the steps of injection moulding a nozzle body in a first mould; exposing at least a portion of the body from the first mould; impressing a second mould against at least a portion of the exposed portion of the body; and then sintering the body.

In a fourth aspect, the present invention provides an apparatus and method as described herein.

Further details of these and other aspects of the present invention will be apparent from the detailed description and figures included below.

DESCRIPTION OF THE DRAWINGS

Reference is now made to the accompanying figures depicting aspects of the present invention, in which.

DETAILED DESCRIPTION OF THE PREFERRED EMBODIMENTS

Figure 1:
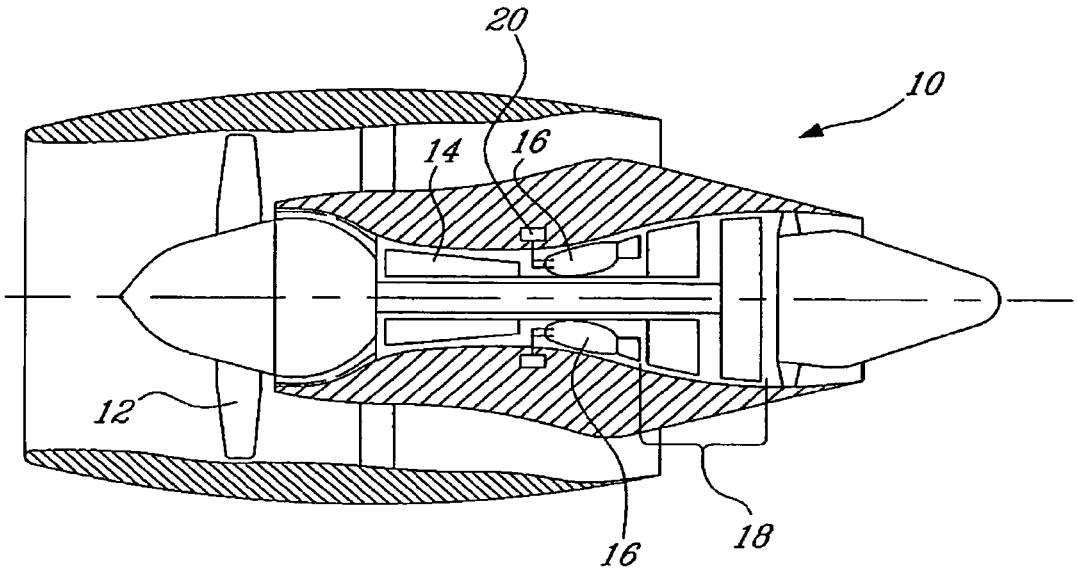
FIG. 1 shows a gas turbine engine including the invention.
Figure 2:
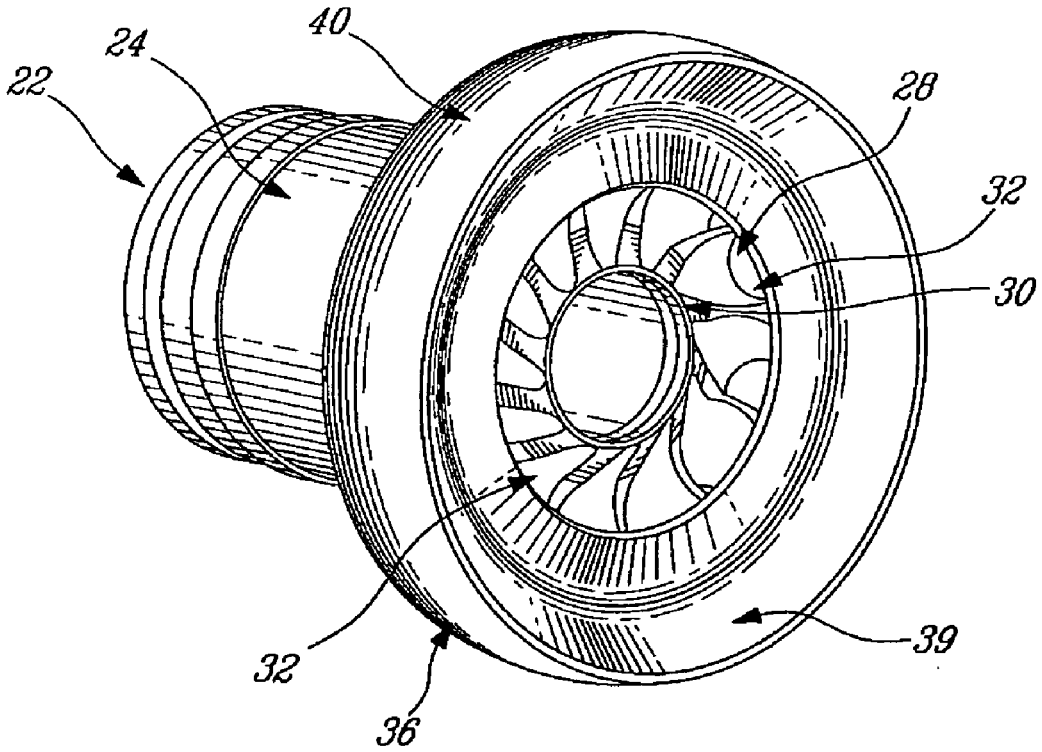
FIG. 2 is an isometric view of a fuel nozzle according to one embodiment of the present invention.
Figure 3:
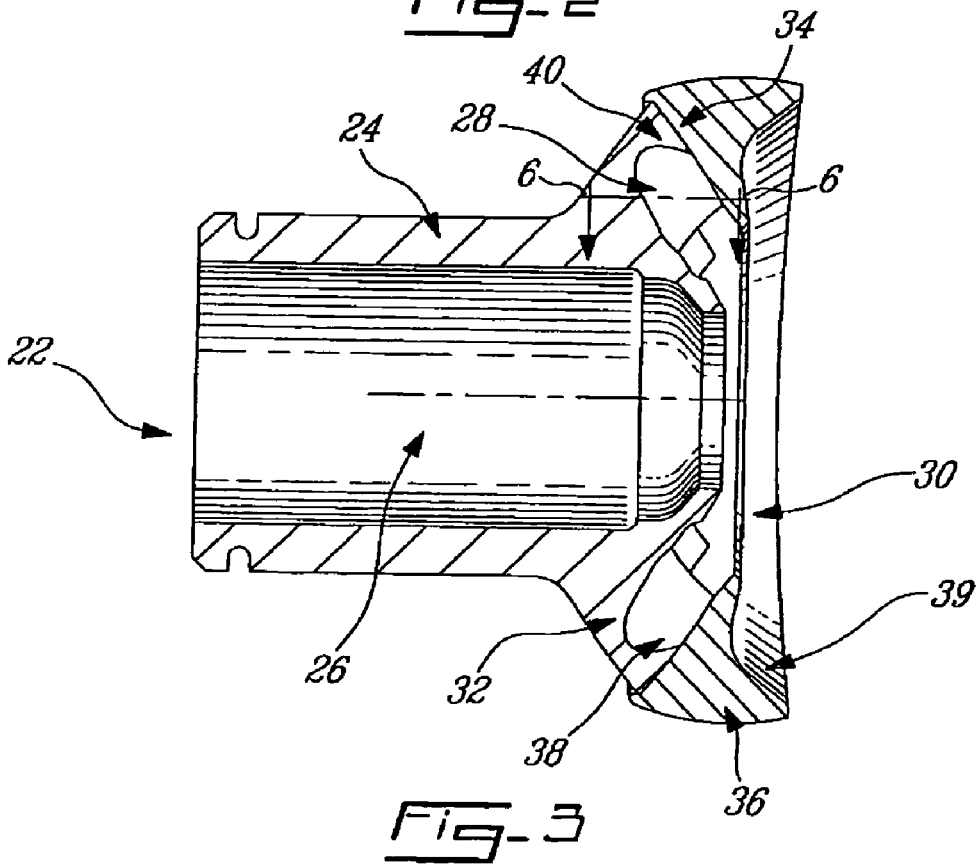
FIG. 3 is a cross-sectional view of the fuel nozzle of FIG. 2.
Figure 4A:
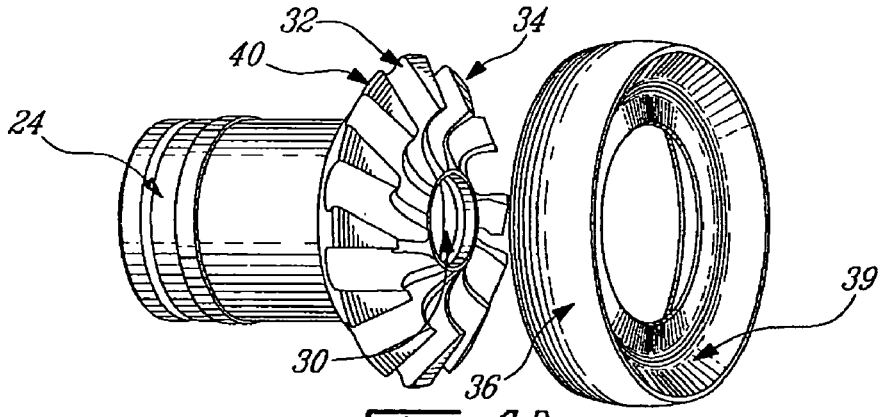
FIGS. 4*a* and 4*b* are respectively an exploded isometric view and a front view of the fuel nozzle of FIG. 2, the front annular collar of the nozzle being omitted in FIG. 4*b* to reveal the channels in the fuel nozzle body.
Figure 4B:
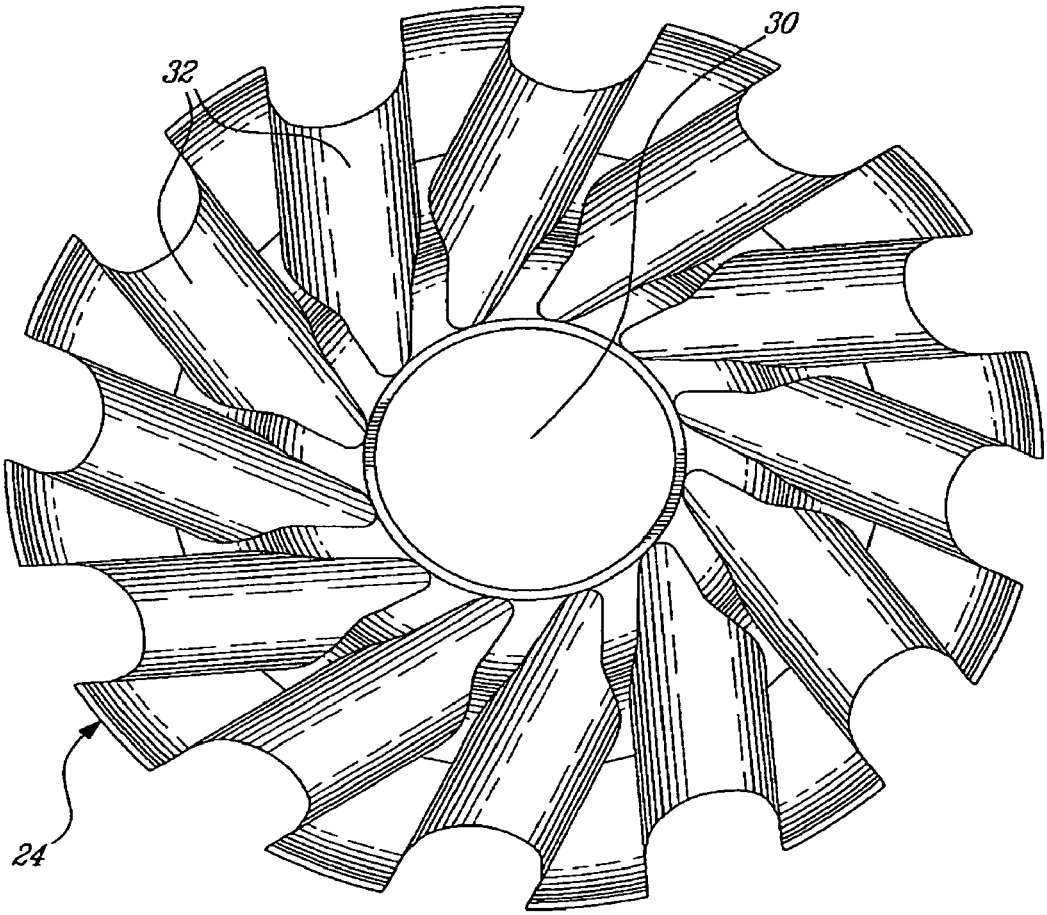
Figure 5:
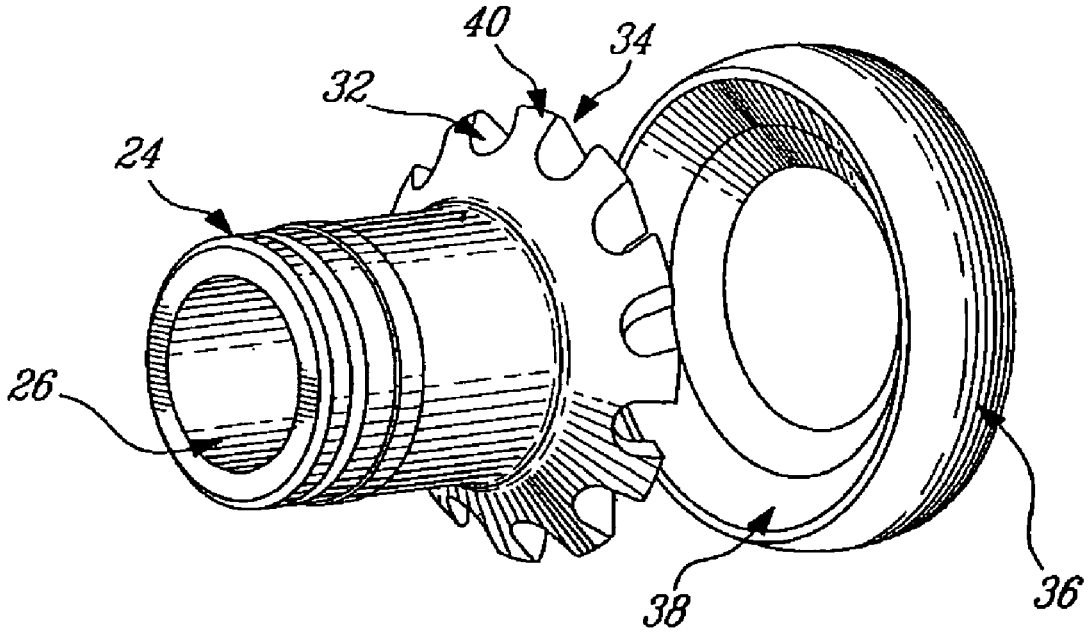
FIG. 5 is a rear view of FIG. 4*a;*

Referring now to FIG. 1., a turbofan gas turbine engine 10 has in serial flow communication a fan 12 through which ambient air is propelled, a compressor 14 for further pressurizing a portion of the air, a combustor 16 in which the compressed air is mixed with fuel and ignited, and a turbine section 18 for extracting rotational energy from the combustion gases. The combustor 16 includes a plurality of fuel nozzles 20 according to the present invention, as will be now be described in more detail.

Referring now to FIGS. 2–5, nozzle 20 includes a nozzle tip 22 which is in this embodiment an air-blast type, meaning that the tip 22 has a body 24, commonly known as a fuel distributor, which has at least a fuel passage 26 defined therethrough, preferably with a fuel swirler 27 therein (not shown, but see FIG. 12), and an array of air passages 28 encircling an spray orifice exit 30 of the fuel passage 26. The fuel swirler 27 may be provided in accordance with the applicant's co-pending application Ser. No. 10/743,712, filed Dec. 24, 2003. The air passages are comprised of open-section channels 32 defined in a conical peripheral surface 34 of the body 24, the spray orifice 30 being located at the apex (not indicated) of the conical peripheral surface 34. (The skilled reader will appreciate that the term "conical" is used loosely to also encompass frustoconical surfaces, and other similarly angled surfaces.) The channels 32 radiate away from the spray orifice along the conical peripheral surface 34. The open-section channels 32 are closed in this embodiment by an annular collar or cap 36 mounted around the body 24, the cap 36 having a smooth inner conical surface 38 co-operating with channels 32 and conical peripheral surface 34 to thereby provide closed-sectioned channels 32. This provides a configuration which may be conveniently provided using relatively inexpensive manufacturing techniques such as grinding or injection moulding, rather than drilling, as will be described further below. The cap 36 also has an aerodynamic outer surface 39, designed to optimise nozzle spray pattern and mixing characteristics. Surface 39, and in fact many other features of tip 22 may be provided generally in accordance with the teaching of the Applicant's U.S. Pat. No. 6,082,113, incorporated herein by reference, as will be appreciated by the skilled reader. It will be appreciate that air passages 28 and channels 32 provide aerodynamic surfaces for the delivery of air and fuel-air mixtures, and thus are subject to aerodynamic design constraints. Thus, the manner is which such features may be successfully manufactured is affected.

The channels 32, with the side-by-side arrangement, result in web portions 40 therebetween. Web portions 40 preferably intimately contact inner surface 38, for reasons to be described further below. The skilled reader will appreciate that surfaces such as those of channels 32 are aerodynamically designed to promote mixing, swirl, efficient air and fluid flow, etc.

Figure 6:
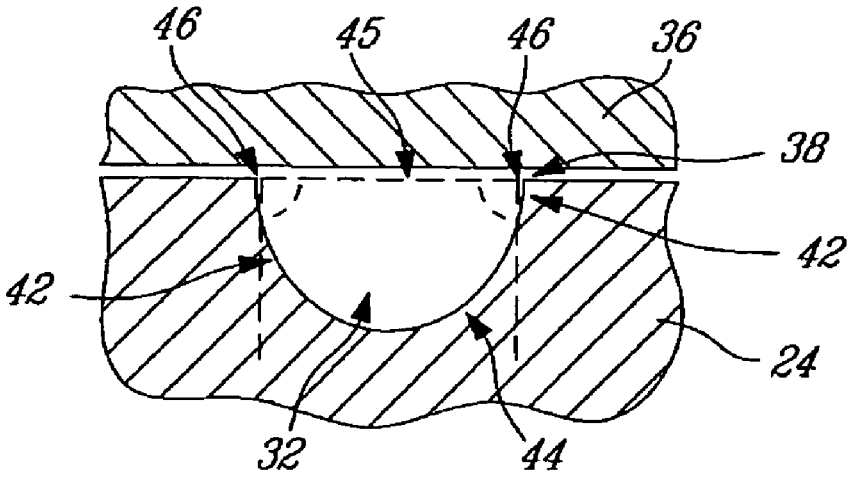
FIG. 6 is a cross-sectional view of the nozzle of FIG. 3, taken along the lines 6—6.

Referring to FIG. 6, channel 32, when viewed in lateral cross-section, has side walls 42 and bottom wall 44. In the embodiment depicted, sidewalls 42 and bottom wall 44 have the same general radius of curvature, and thus the transition between them is indistinct. Side and bottom walls 42, 44 may, however, have any radius (including infinite radius, or in other words, be generally planar) and may have any combination of portions having differing radii or planar portions—i.e. the shape of side and bottom walls 42, 44 is almost limitless. In order to facilitate simple manufacturing of channels 32, however, as mentioned above channel 32 has an "open-section", meaning that side walls 42 are either parallel to one another or converge towards one another, relative to the viewpoint shown in FIG. 6. As indicated by the dotted lines in FIG. 6, this means that the angle between walls 42 at any location and an imaginary line 46 joining opposed intersection points 46 is 90° or less (the skilled reader will appreciate that the "point" 46 is in fact a line out of the plane of the page of FIG. 6). The sidewall 42 and bottom wall 44 thus subtend an angle of 180° or less, as measured from a midpoint of the above-mentioned imaginary line 45. This configuration permits a tool, such as a milling or grinding tool, or a mounting tool, to be inserted and withdrawn generally normally (perpendicular) from the channel—that is, such a tool may be used to form the channel 32, and then subsequently normally (perpendicularly) withdrawn form the channel, thus greatly simplifying the motion and tools required in manufacture of the nozzle tip 22. This can also be readily appreciated from FIGS. 4*a*, 4*b* and 11. Drilling or a complex mould(s) is not required, which can decrease cost of manufacture and permit improved manufacturing tolerances.

Figure 7:
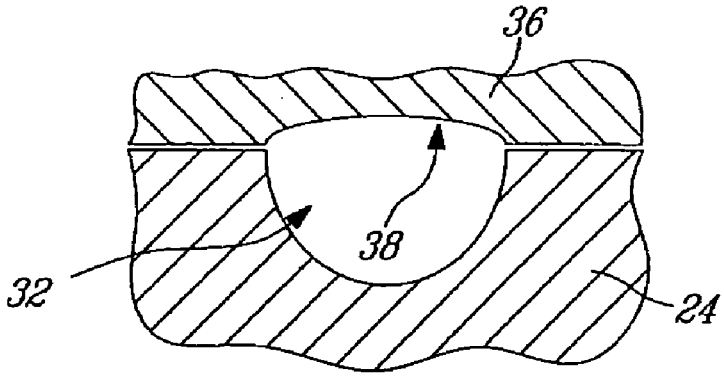
FIG. 7 is a view similar to FIG. 6, showing an alternate embodiment of the present invention.
Figure 8:
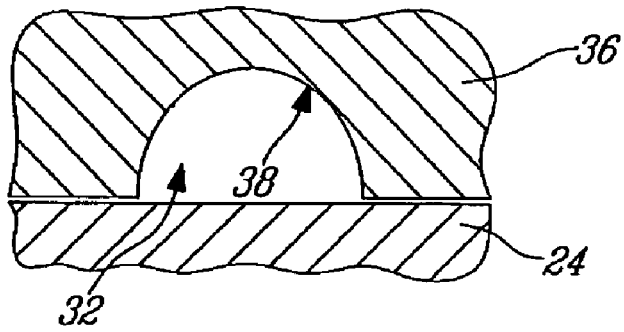
FIG. 8 is a view similar to FIG. 6, showing another embodiment of the present invention.
Figure 9:
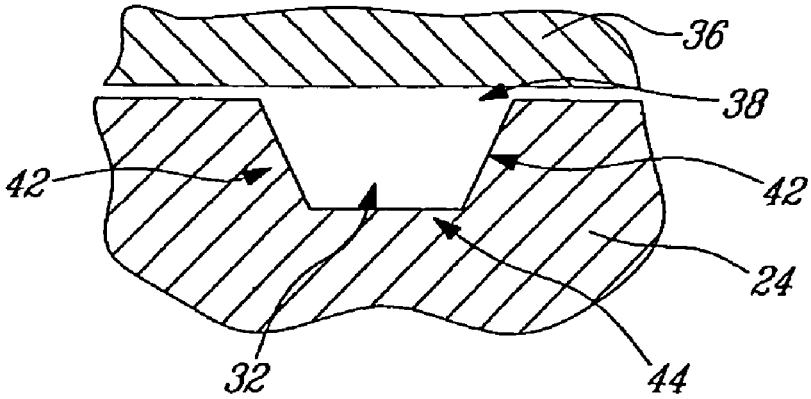
FIG. 9 is a view similar to FIG. 6, showing another embodiment of the present invention.

As represented briefly in FIGS. 7–9, and as will be understood by the skilled reader in light of the present disclosure, passage 28 is defined through the co-operation of two or more surfaces, in this case tow surfaces are provided by nozzle body 24 and cap 36. Thus the channel 32 may in fact be a pair of channels, one defined in each of nozzle body 24 and cap 36 (FIG. 7) for example, or may be entirely defined in cap 36 (FIG 8), and/or maybe non-circular (FIG. 9). A variety of configurations is thus available. Not all passages 28 need be identical, either. Other elements besides body 24 and cap 36 may be employed, as well, as described below.

The geometry of the channels allows simpler manufacturing. For example, a grinding tool may be used to grind the channel by inserting the tool (i.e. as grinding progresses) in a purely axial direction (i.e. vertically down the page in the FIG. 6 or perpendicular to the page in FIG. 4*b*) and then extracted in the reverse direction without damaging the channel. Simplified machining operations results in part cost savings, and typically improved tolerances.

Perhaps more advantageously, however, the described configuration permits injection moulding operations to be used, as will now be described in more detail.

Figure 10:
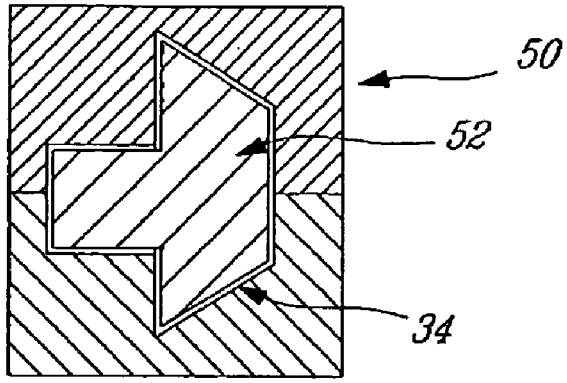
FIGS. 10–12 schematically depict a method of manufacture according to the present invention.
Figure 11:
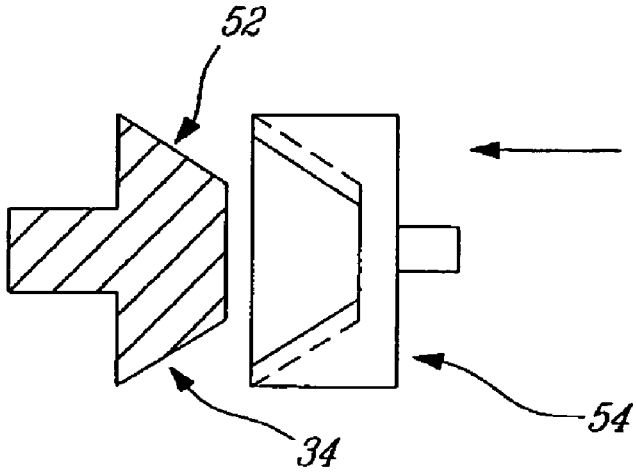
Figure 12:
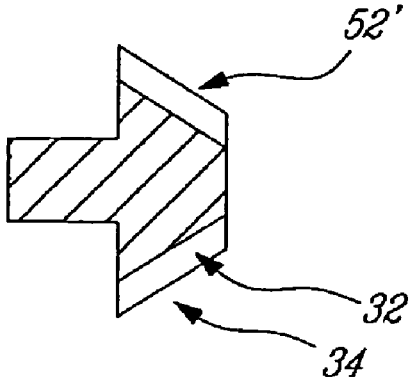

Referring to FIGS. 10–12, in one embodiment, the present invention is injection moulded, using generally typical metal injection moulding techniques, except where the present invention departs from such techniques. The present method will now be described. As represented schematically and cross-sectionally in FIG. 10, such moulding can be done in a mould 50 to provide a body blank 52, and another mould provides a cap blank (neither the cap mould nor cap are shown). Referring to FIG. 11, the body blank 50 is removed from the mould 52 and while still green (i.e. pliable), a form 54 is pressed into the body blank 52, preferably in a purely axial direction (indicated by the large arrow) to form channels 32 in the body 52. The form 54 is then extracted in the reverse direction. The "open" channel geometry described above permits this extraction to be done simply without damaging the shape of the channels in the still-soft body 52. Referring to FIG. 12, the body, now indicated as body 52', is thus left with channels 52 impressed therein. The body 52 may then be heat treated in a conventional fashion to provide the final nozzle 22. Preferably, the "green" body 24 and cap 36 are joined to one another during this sintering operation. The body 24 and cap 36 are moulded separately and placed adjacent to one another before the final sinter operation. In the furnace, the two bodies are joined by sintering, which eliminates an extra step of attaching the two together, for example by brazing or other conventional operations.

Thus, a novel method of manufacturing nozzle tip 22 is also provided. Furthermore, the 'open' channel design described above permits the channels 32 to be moulded using relatively simple moulding tooling and operation. As the skilled reader will appreciate, is a "closed" section channel would prevent easy withdrawal or the mould or form from the channels, and thus would require the provision of a much more complex mould, thus increasing manufacturing costs.

The present invention thus permits reproduction of a proven fuel nozzle design (e.g. as generally described in the Applicant's U.S. Pat. No. 6,082,113) in a modular form, which permits the use of much cheaper manufacturing operations, while minimizing the aerodynamic compromises which impact nozzle performance. The multi-piece tip also allows for dissimilar materials for the construction of the part, such as the provision of a harder material to be used on the cap portion to protect against fretting, and thus prolong life—and should wear occur, only the cap need be repaired or replaced. Perhaps more significantly, however, the two-piece design eliminates thermal stresses in the webs of the channels, which stresses often lead to cracking. The configuration, by allowing for flexibility in modes of manufacturing, also thereby allows for non-circular channels to be used, which may permit an increase in the flow area of the channel for a given tip geometry. The invention provides an economical yet relatively accurate way to provide the nozzles.

Figure 13:
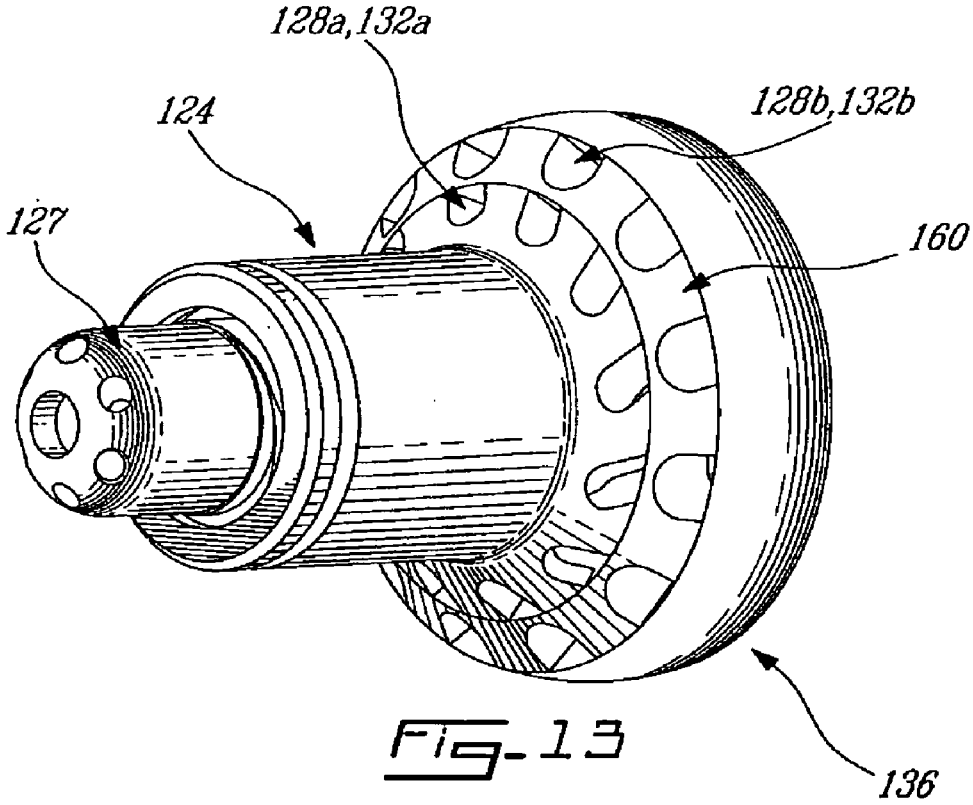
FIG. 13 is a rear isometric view of another embodiment.
Figure 14A:
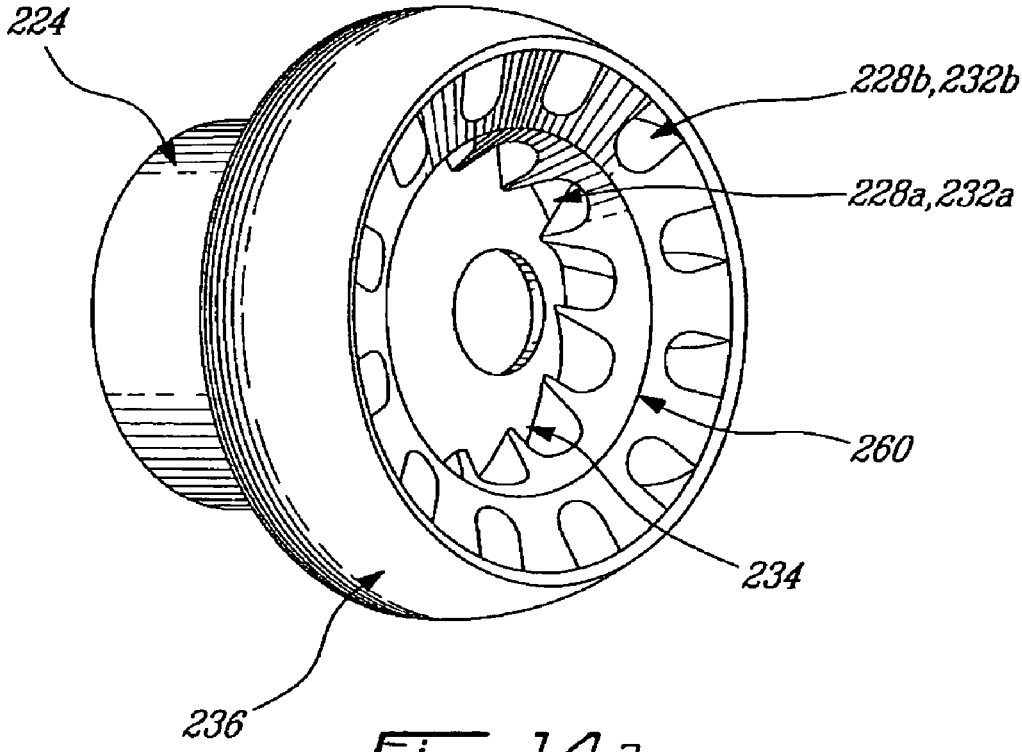
FIG. 14*a* is a front isometric view of yet another embodiment, and FIG. 14*b* an isometric view of a modular component thereof.
Figure 14B:
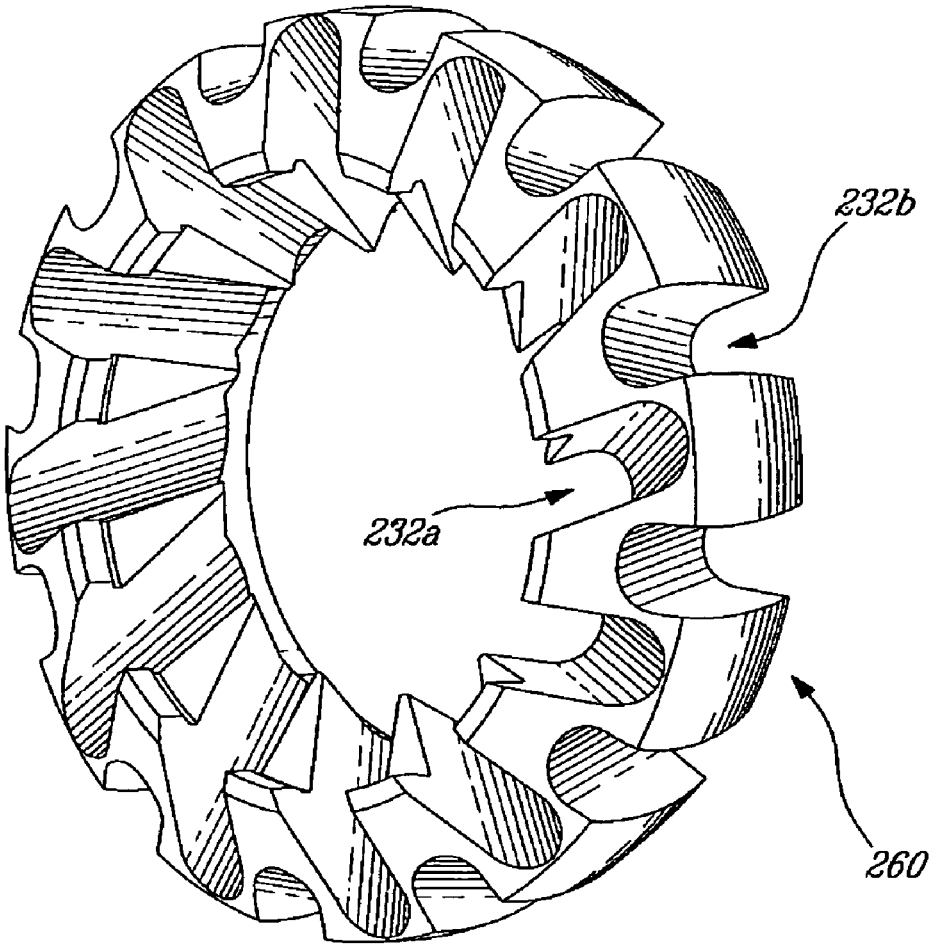

The above description is meant to be exemplary only, and one skilled in the art will recognize that changes may be made to the embodiments described without departing from the invention disclosed. For example, other nozzles styles may employ the present invention, such as simplex or duplex air-associated nozzles, and the present invention is not limited only to the nozzle types described. For example, referring to FIG. 13, the present invention may be used to provide concentric arrays of air passages 128*a* and 128*b*, respectively provided in the body 124 and an annular collar or ring 160 (elements depicted which are analogous to the embodiments described above are indicated with similar references numerals, incremented by 100). Referring to FIGS. 14*a* and 14*b*, in another example, dual concentric air passages 228*a* and 228*b* are both provided both in annular ring 260 (one on the inner annular surface of ring 260, and one on the outer annular surface of ring 260), thereby permitting a simpler body 224 and cap 236 to be provided. Simplex and duplex configurations may be provided. The present method is not limited in use to manufacturing fuel nozzles, and other aerodynamic and non-aerodynamic apparatus may be made using these techniques. Still other modifications will be apparent to those skilled in the art, in light of this disclosure, and such modifications are intended to fall within the invention defined in the appended claims.

What is claimed is:

1. A fuel nozzle for a gas turbine engine, the nozzle comprising:

a body defining at least a central fuel passage therethrough, the fuel passage having an axis defining an axial direction and exiting the body through a spray orifice coaxial with the axis, the body having a conical peripheral surface with the spray orifice disposed at an apex of the conical peripheral surface, the conical peripheral surface including a plurality of channels defined therein, the channels radiating along the conical peripheral surface around the spray orifice, each of the channels having a cross-sectional contour that does not exhibit any undercut portion when viewed along any axis parallel to the axis, thereby permitting withdrawal of a channel forming tool form the channels in a direction parallel to the axis; and an annular collar mounted to the body, the collar and the conical surface of the body co-operating to define a plurality of enclosed air swirl passages corresponding to the channels.

2. The fuel nozzle of claim 1 wherein each channel has opposed walls intersecting the conical surface, and wherein the opposed walls are one of parallel and converging relative to one another, said convergence directed in a direction away from said conical surface.

3. The fuel nozzle of claim 1 wherein each of the channels has an open-section which subtends an angle of less than 180 degrees.

4. The fuel nozzle of claim 1 wherein the annular collar has an inner conical surface intimately mating with the conical peripheral surface.

5. The fuel nozzle of claim 1 further comprising a second annular collar disposed around said annular collar, the two annular collars co-operating to define a second plurality of channels therebetween.

6. A fuel nozzle for a gas turbine engine, the nozzle comprising:

a body defining at least one fuel passage centrally therethrough, the fuel passage having an axis defining an axial direction and exiting the body through a spray orifice, the body having a conical peripheral surface with the spray orifice disposed at an apex of the conical peripheral surface, an annular collar mounted to the body around the conical surface, the collar and conical surface of the body co-operating to define a plurality of air passages therebetween, the air passages arranged in an array radiating around the spray orifice;

wherein at least one of the body and the annular collar have a plurality of channels defined therein, the channels partially defining the air passages, each of the channels having a cross-sectional contour that does not exhibit any undercut portion when viewed along any axis parallel to the axis, thereby permitting withdrawal of a channel forming tool from the channels in a direction parallel to the axis.

7. The fuel nozzle of claim 6 further comprising a second annular collar mounted around the first annular collar, the first and second collars co-operating to define a second plurality of air passages therebetween.

8. The fuel nozzle of claim 7 wherein the second plurality of air passages are arranged in an array which is concentrically aligned with said first-mentioned array of passages.

9. The fuel nozzle of claim 6 wherein each channel has opposed walls intersecting the conical surface, and wherein the opposed walls are one of parallel to and converging relative to one another, said convergence directed in a direction away from said conical surface.

10. The fuel nozzle of claim 6 wherein each of the channels has an open-section which subtends an angle of less than 180 degrees.

11. The fuel nozzle of claim 6 wherein the annular collar has an inner conical surface intimately mating with the conical peripheral surface.

12. The fuel nozzle of claim 7 wherein the second collar has an inner conical surface intimately mating an outer surface of first-mentioned annular collar.

13. The fuel nozzle of claim 12 wherein the outer surface of first-mentioned annular collar is conical.

* * * * *